United States Patent [19]

Long et al.

[11] Patent Number: 4,544,476

[45] Date of Patent: Oct. 1, 1985

[54] COAL LIQUEFACTION AND HYDROGENATION

[75] Inventors: Raymond H. Long, Morristown; Harvey D. Schindler, Fair Lawn, both of N.J.

[73] Assignee: The Lummus Company, Bloomfield, N.J.

[21] Appl. No.: 559,096

[22] Filed: Dec. 7, 1983

[51] Int. Cl.[4] ..... C10G 1/00

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,867,275 | 2/1975 | Gleim et al. | 208/8 LE |
| 4,022,680 | 5/1977 | Maa | 208/8 LE |
| 4,051,012 | 9/1977 | Plumlee et al. | 208/8 LE |
| 4,081,359 | 3/1978 | Gatsis et al. | 208/8 LE |
| 4,133,646 | 1/1979 | Farcasiu et al. | 208/8 LE |
| 4,283,268 | 8/1981 | Rosenthal et al. | 208/8 LE |
| 4,300,996 | 11/1981 | Kuehler | 208/8 LE |
| 4,312,746 | 1/1982 | Tsai et al. | 208/8 LE |
| 4,328,088 | 5/1982 | Anderson et al. | 208/8 LE |
| 4,334,977 | 6/1982 | Derbyshire et al. | 208/8 LE |
| 4,371,727 | 2/1983 | Gavin | 208/8 LE |
| 4,372,838 | 2/1983 | Kulik et al. | 208/10 |
| 4,374,015 | 2/1983 | Brulé | 208/10 |

*Primary Examiner*—D. E. Gantz
*Assistant Examiner*—Lance Johnson
*Attorney, Agent, or Firm*—Elliot M. Olstein

[57] ABSTRACT

In a two-stage liquefaction, hydrogenated 850° F.+ residuum from the second stage is used in formulating the first stage liquefaction solvent.

10 Claims, 1 Drawing Figure

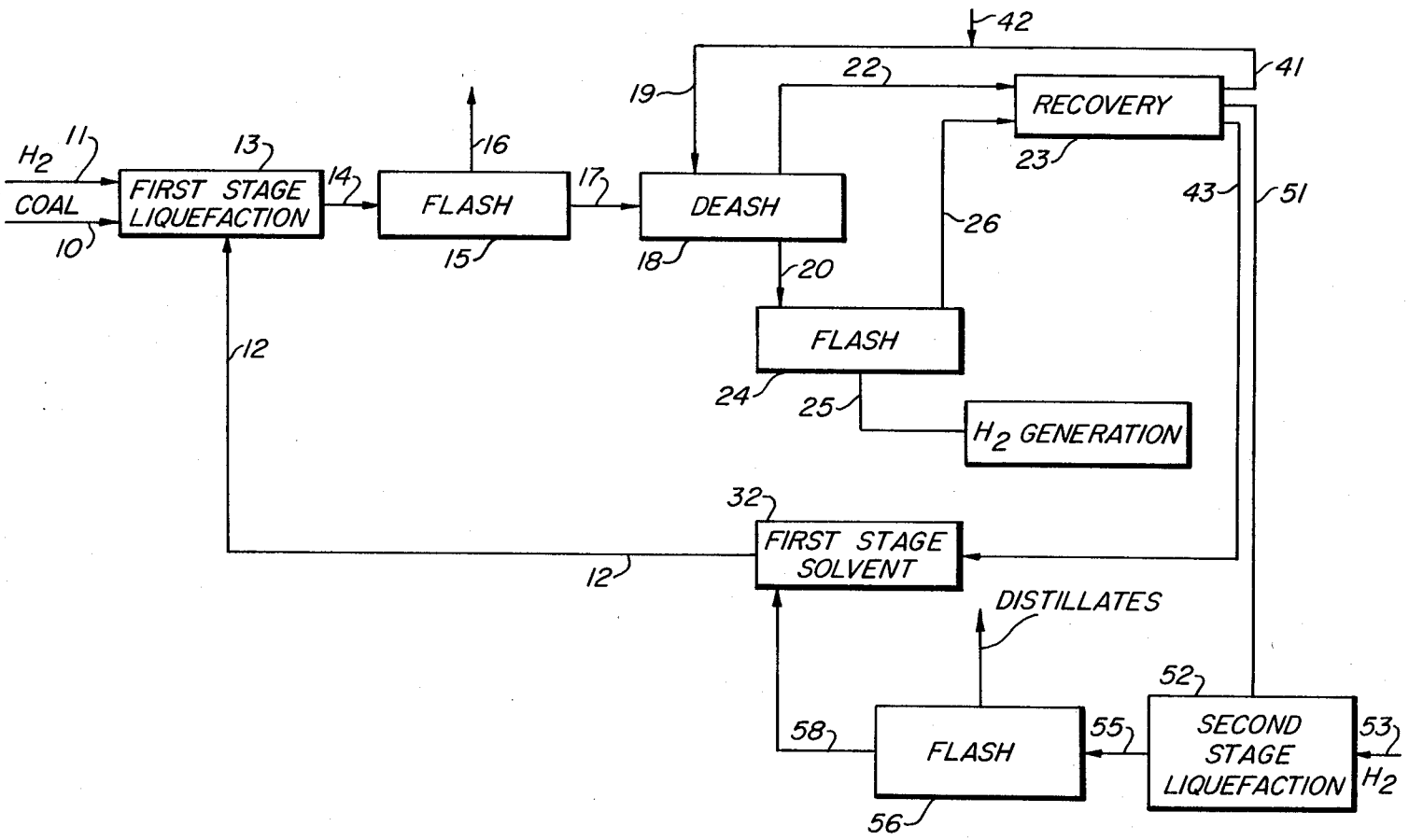
FIRST STAGE LIQUEFACTION
FLASH
DEASH
FLASH
RECOVERY
$H_2$ GENERATION
FIRST STAGE SOLVENT
FLASH
SECOND STAGE LIQUEFACTION
DISTILLATES
$H_2$
COAL
10
11
12
13
14
15
16
17
18
19
20
22
23
24
25
26
32
41
42
43
51
52
53
55
56
58

COAL LIQUEFACTION AND HYDROGENATION

The present invention relates to liquefaction of coal, and more particularly to improvements in a two-stage process for coal liquefaction.

Coal has been liquefied in a single liquefaction stage comprised of a preheater coil where coal liquefaction is essentially completed, followed by a dissolver, where both liquefaction solvent and coal derived liquids are further hydrogenated.

Recently, there has been proposed a so-called two-stage liquefaction process wherein the first reaction stage is a short contact time thermal liquefaction, followed by recovery of essentially ash free liquid, which is upgraded by hydrogenation in a second liquefaction stage.

The present invention is directed to an improvement in such a two-stage liquefaction process.

In accordance with the present invention, there is provided an improvement in a two-stage liquefaction process wherein the liquefaction solvent to the first stage includes hydrogenated material recovered from the second stage liquefaction. Applicant has found that the use of the hydrogenated residuum (850° F. material) from the second stage in formulating the first stage liquefaction solvent improves the overall coal conversion and also improves the operation of the second stage.

In accordance with a preferred embodiment, the first stage liquefaction is a short contact thermal liquefaction which is operated at an outlet temperature in the order of from 800° to 875° F., and particularly 820° F. to 865° F., at a pressure in the order of from 500 to 2700 psig and in cases where higher amounts of hydrogen are required the pressure may be from 1800 to 2700 psig, and at reaction contact times (at temperatures above 600° F.) in the order of from 2 to 15 minutes. The coal liquefaction solvent employed in the first stage is provided in an amount such that the ratio of solvent to coal is in the order of from 1.2:1, to 3:1, on a weight basis. It is to be understood that greater amounts could be employed but, in general, such greater amounts are not economically justified. In addition, hydrogen, when used, may be added to the first stage in an amount of from 4000 to 15,000 SCF per ton of coal; however, higher or lower amounts may be employed.

The above conditions are illustrative, and the scope of the invention is not to be limited thereby.

After treatment to remove insoluble matter, 850° F.+ liquid which is essentially free of insoluble material is contacted with hydrogen in a second stage to further upgrade the material.

In accordance with the present invention, hydrogenated 850° F.+ material recovered from the second stage effluent is used in formulating the first stage liquefaction solvent, and in general, essentially all of the 850° F.+ material recovered from the second stage effluent is utilized in formulating the first stage solvent; i.e., no net make of 850° F.+ product. In addition, 850° F.− material recovered from the second stage is used in formulating the first stage solvent. The 850° F.− material (generally material which boils within the range of 650° F. to 850° F.) provides additional hydrogenated material for use in providing liquefaction solvent for the first stage. In addition, the 850° F.− material functions as a diluent for the 850° F.+ residuum to thereby provide a pumpable mixture for use as liquefaction solvent for the first stage.

The coal liquefaction solvent for the first stage generally contains at least 10%, and most generally at least 20%, by weight, of 850° F.+ material recovered from the second stage effluent. In most cases, such 850° F.+ material is present in an amount which does not exceed 50%, by weight, of the first stage liquefaction solvent. In general, the remainder of the liquefaction solvent is comprised of 850° F.− material having an initial boiling point of at least 500° F.

The 850° F.− material present in the first stage liquefaction solvent is derived from both the first and second stage effluents, with the amount of 850° F.− material which is derived from the second stage being dependent upon the amount required to provide a pumpable stream of 850° F.+ material from the second stage and the amount of 850° F.− material available from the first stage. The 850° F.− material recovered from the second stage contains hydrogenated components and, therefore, further improves the quality of the solvent.

The first stage liquefaction solvent is thus comprised of all of the 850° F.+ material recovered from the second stage as well as 500° F. to 850° F. material, all of which is indigenous to the process, i.e., derived from coal. The 850° F.+ material used in the first stage liquefaction solvent is the full range of material which boils above the nominal boiling temperature of 850° F.+, which is derived from the coal and which is present in the second stage effluent.

In accordance with a preferred embodiment, the first stage effluent is deashed by the use of a liquid promoter having a characterization factor of at least 9.75, a 5 volume percent distillation temperature of at least about 250° F., and a 95 volume percent distillation temperature of at least about 350° F. and no greater than about 750° F., as described in U.S. Pat. No. 3,856,675. As described in such patent, a preferred promoter liquid is a kerosene fraction having a 5% and 95% volume distillation temperature of 425° F. and 500° F., respectively.

Liquid essentially free of insoluble material (no more than 0.5% ash) recovered from the deashing is then treated in a recovery zone to recover promoter liquid, if such promoter liquid is employed in the deashing, components boiling below 850° F., which are generally used in formulating the liquefaction solvent, with higher boiling materials, i.e., 850° F.+ material, being employed as feed to the second stage liquefaction. The 850° F.+ material used as feed to the second stage is in admixture with some 850° F.− material so as to provide a pumpable mixture for passage to the second stage.

In the second stage liquefaction, the 850° F.+ material is contacted with hydrogen at temperatures of at least 650° F. and generally in the order of from 680° F. to 850° F., and at pressures in the order of from 2000 to 3000 psig, with contact times being in the order of from 1 to 5 hours. In the second stage, such contacting is effected in the presence of a hydrogenation catalyst of a type known in the art. For example, an oxide or sulfide of a group VI and group VIII metal, such as a cobalt-molybdenum or nickel-molybdenum catalyst, supported on a suitable support such as alumina or silica-alumina. Such hydrogenation converts a portion of the 850° F.+ material to distillates (850° F.− material) and also produces hydrogen donors in the 850° F.+ residuum. The 850° F.+ residuum is used in producing the liquefaction solvent for the first stage.

In accordance with a preferred embodiment, such second-stage liquefaction is accomplished in an upflow expanded bed, with such expanded beds being known in the art.

The effluent from the second stage liquefaction is then subjected to a flashing step to recover 850° F.− components, free of components boiling above about 850° F., as a flashed gas.

The unflashed product contains all of the 850° F.+ material, as well as 850° F.− material (generally 650°–850° F.). The 850° F.− material provides a pumpable mixture and also provides hydrogenated 850° F.− material for formulating first stage liquefaction solvent.

The invention will be further described with respect to an embodiment thereof illustrated in the accompanying drawing, wherein:

The drawing is a simplified schematic block flow diagram of an embodiment of the invention.

It is to be understood, however, that the scope of the invention is not to be limited to the particularly described embodiment.

Referring now to the drawing, ground pulverized coal, generally bituminous, sub-bituminous or lignite, preferably bituminous coal, in line 10, hydrogen in line 11, and a coal liquefaction solvent, in line 12, obtained as hereinafter described, are introduced into the first stage liquefaction zone, schematically generally indicated as 13 for effecting a short contact thermal liquefaction of the coal. The thermal liquefaction is effected in the absence of catalyst. The first stage liquefaction is operated at the conditions hereinabove described.

A first stage coal liquefaction product is withdrawn from zone 13 through line 14, and introduced into a flash zone, schematically generally indicated as 15 in order to flash therefrom materials boiling up to about 500° 600° F. Such flashed materials are removed from flash zone 15 through line 16. The flash zone 15 is operated primarily for the purpose of flashing materials which boil up to the end point of the promoter liquid to be employed in the subsequent deashing process.

The remainder of the coal liquefaction product, in line 17, is introduced into a deashing zone, schematically generally indicated as 18 for separating ash and other insoluble material from the first stage coal liquefaction product. As particularly described, the deashing in zone 18 is accomplished by use of a promoter liquid for promoting and enhancing the separation of the insoluble material, with such promoter liquid being provided through line 19. In particular, the separation in deashing zone 18 is accomplished in one or more gravity settlers, with the promoter liquid and general procedure for accomplishing such deashing being described, for example, in U.S. Pat. No. 3,856,675.

The essentially ash free overflow is withdrawn from deashing zone 18 through line 22 for introduction into a recovery zone, schematically generally indicated as 23.

An insoluble material containing underflow is withdrawn from deashing zone 18 through line 20, and introduced into a flash zone, schematically generally indicated as 24 to flash materials boiling between 850° F. therefrom. The flashing in zone 24 is accomplished in a manner such that there is recovered from flash zone 24, through line 25, a flowable insoluble material containing 850° F.+ liquid. The flashed components are withdrawn from flash zone 24 through line 26 for introduction into the distillation column of recovery zone 23.

The 850° F.+ material in line 25 may be used as feedstock to a partial oxidation process for producing hydrogen.

The recovery zone 23 may include an atmospheric flash as well as a distillation column, with the atmospheric flash being operated to flash 850° F.− material free of 850° F.+ material from the deashed liquid, with the unflashed material being distilled to recover promoter liquid through line 41 (for example 425° F. to 500° F. material) with the remainder (500° F. to 850° F.) being recovered through line 43 for use in formulating the first stage liquefaction solvent in first stage liquefaction solvent zone 32.

Make-up promotor liquid may be added through line 42. The material recovered from the atmospheric flash in recovery zone 23 through line 51 includes the 850° F.+ material present in the ash free overflow recovered from deashing zone 18, as well as a portion of the 850° F.− material (generally 650° F. to 850° F. material) so as to provide a pumpable feed for introduction into a second stage liquefaction zone, schematically generally indicated as 52, along with hydrogen in line 53. The second stage liquefaction zone 52 is operated at temperatures, and pressures, as hereinabove described, preferably with the use of a coal liquefaction catalyst of the type hereinabove described, to upgrade a portion of the 850° F.+ material to lower boiling components.

In accordance with a preferred embodiment, the second liquefaction stage is in the form of an upflow expanded bed.

The effluent from the second stage liquefaction, in line 55 is introduced into a flash zone, schematically generally indicated as 56 to recover as flashed product through line 57 850° F.− material, free of 850° F.+ material, which may be further treated or used in a manner similar to petroleum distillates.

The unflashed portion of the effluent recovered through line 58 includes all of the 850° F.+ material present in the second stage effluent, as well as unflashed 850° F.− material (generally 650° F. to 850° F. material). As hereinabove described, the 850° F.− material dilutes the 850° F.+ material so as to provide a pumpable mixture. In addition, the 850° F.− material provides hydrogenated 850° F.− components which enhance the quality of the liquefaction solvent.

Although the invention has been described with respect to a particular embodiment, it is to be understood that the invention is not limited to such embodiment. Thus, for example, the deashing may be accomplished other than as particularly described. Similarly, the second stage liquefaction may be accomplished other than as particularly described; i.e., other than by use of an upflow expanded bed.

These modifications and others should be apparent to those skilled in the art from the teachings herein.

The invention will be further described with respect to the following example; however, the scope of the invention is not to be limited thereby:

EXAMPLE

The following illustrates two-stage liquefaction in accordance with the invention:

| First Stage | |
|---|---|
| Temperature, °F. | 840 |
| Pressure, psig | 2000 |
| $H_2$, lbs. | 0.08 |

-continued

| Second Stage | |
|---|---|
| Temperature, °F. | 750 |
| Pressure, psig | 2700 |
| $H_2$, lbs. | 1.6 |

Thirty-six pounds of coal are fed through line 10 in conjunction with 64 lbs. of liquefaction solvent in line 12, formulated as hereinafter described.

The first stage produces 4.0 lbs. of 500° F.− product (line 16), and in line 25, 3.6 lbs. ash, 2.6 lbs. of unconverted coal and 6.7 lbs. of 850° F.+ material.

The feed to the second stage (line 51) is comprised of 31.6 lbs. of 650° F.–850° F. material and 38.7 lbs. of 850° F.+ material.

20.7 lbs. of 850° F.− product (line 57) is recovered from the second stage.

The liquefaction solvent (line 12) is formulated from 12.8 lbs. 500°–850° F. material from the first stage (line 43); and from the second stage, a mixture of 29.8 lbs. of 650°–850° F. material and 21.4 lbs. of 850° F.+ material (line 58).

The present invention is particularly advantageous in that the use of hydrogenated 850° F.+ material from the second stage effluent improves the quality of the liquefaction solvent, which reduces hydrogen requirements for the first stage. Furthermore, by using 850° F.+ material from the second stage in the first stage liquefaction solvent there is no net yield of 850° F.+ material in the second tage and no need to provide for a purge of refractories in the second stage. Moreover, there is an increase in yield of 850° F.− material in the first stage.

These and other advantages should be apparent to those skilled in the art from the teachings herein.

Numerous modifications and variations of the present invention are possible in light of the above teachings and, therefore, within the scope of the appended claims, the invention may be practised otherwise than as particularly described.

What is claimed is:

1. A two-stage process for the liquefaction of coal, comprising:

contacting coal with liquefaction solvent in a first stage coal liquefaction zone to produce a first effluent; hydrogenating at least a portion of the first effluent in a second stage to produce a second effluent comprising 850° F.− material and 850° F.+ material; recovering from the second effluent a (portion of the) first stream comprising 850° F.− material as product and a second stream comprising a mixture of 850° F.− material and 850° F.+ material; and directly employing said mixture, without additional hydrogenation, as at least a portion of the liquefaction solvent used in the coal liquefaction zone.

2. The process of claim 1 wherein the first stage is a thermal liquefaction operation at a temperature of from 850° F. to 875° F. at a reaction contact time of from 2 to 15 minutes.

3. The process of claim 2 wherein the second stage hydrogenation is effected in an expanded bed of hydrogenation catalyst.

4. The process of claim 1 wherein the 850° F.− material had an initial boiling point of at least 500° F.

5. A process for the two-stage liquefaction of coal, comprising:

contacting coal with a liquefaction solvent in a first stage to produce a first elluent; de-ashing the first effluent to produce an essentially ash-free coal liquid; separating from the ash-free coal liquid a portion of the 850° F.− material and a feed mixture comprising 850° F.+ material and 850° F.− material; hydrogenating the feed mixture in a second stage to produce a second effluent comprising 850° F.− material and 850° F.+ material; recovering from the second effluent a (portion of the) first stream comprising 850° F.+ material, as product, and a second stream of a remaining mixture of 850° F.+ material and 850° F.− material; and employing the remaining (portion) mixture of the second effluent and the 850° F.− material separated from the ash-free coal liquid, without additional hydrogenation, as the liquefaction solvent for the first stage.

6. The process of claim 5 wherein the first stage is a thermal liquefaction operation at a temperature of from 850° F. to 875° F. at a reaction contact time of from 2 to 15 minutes.

7. The process of claim 6 wherein the second stage hydrogenation is effected in an expanded bed of hydrogenation catalyst.

8. The process of claim 5 wherein the 850° F.− material had an initial boiling point of at least 500° F.

9. The process of claim 8 wherein the 850° F.+ material in the liquefaction solvent is at least 20% by weight, and no greater than 50%, by weight.

10. The process of claim 9 wherein the first stage is a thermal liquefaction operation at a temperature of from 850° F. to 875° F., and the second stage hydrogenation is effected in an expanded bed of hydrogenation catalyst at a temperature of from 680° F. to 850° F.

* * * * *